US006601780B1

(12) United States Patent
Sheng

(10) Patent No.: US 6,601,780 B1
(45) Date of Patent: Aug. 5, 2003

(54) PAINTGUN WITH PNEUMATIC FEEDING AND DISCHARGING PROCESS

(76) Inventor: Chih-Sheng Sheng, No. 100, Tzu Chiang W. Road, Kweishan Hsiang, TaoYuan Hsien (TW)

( * ) Notice: Subject to any disclaimer, the term of this patent is extended or adjusted under 35 U.S.C. 154(b) by 0 days.

(21) Appl. No.: 10/272,952

(22) Filed: Oct. 18, 2002

(51) Int. Cl.[7] ..... B05B 7/32

(52) U.S. Cl. ..... 239/337; 239/325; 239/329; 239/375; 239/377; 239/DIG. 14; 124/51.1; 124/66; 124/71; 124/72

(58) Field of Search ..... 239/325, 329, 239/331, 332, 337, 346, 355, 377, 375, 378, 379, 398, 525, 526, 568, DIG. 14; 124/51.1, 56, 71, 72, 73, 74, 77, 66

(56) References Cited

U.S. PATENT DOCUMENTS 2,631,891 A * 3/1953 Kochner et al. ..... 239/308
2,721,763 A * 10/1955 Miner ..... 239/308
4,628,644 A * 12/1986 Somers ..... 239/378
5,333,594 A * 8/1994 Robinson ..... 124/73
5,494,024 A * 2/1996 Scott ..... 124/73
6,286,497 B1 * 9/2001 Levkov ..... 124/73
6,371,099 B1 * 4/2002 Lee ..... 124/66
6,405,722 B2 * 6/2002 Colby ..... 124/74
6,532,949 B1 * 3/2003 McKendrick ..... 124/77

* cited by examiner

*Primary Examiner*—Robin O. Evans
(74) *Attorney, Agent, or Firm*—Rosenberg, Klein & Lee

(57) ABSTRACT

The present invention relates to a paintgun with pneumatic feeding and discharging process which mainly includes a pneumatic delivery mechanism. The pneumatic delivery mechanism consists of a flow-guiding body, a flow-guiding piston and a delivery tube. The flow-guiding body consists of a major air channel at the front end and a flow-guiding chamber at the rear end thereof. The flow-guiding chamber contains an input port at one side thereof which is in connection with an air pressure source and an output port at the other side thereof which communicates with a minor air channel at the wider part of the flow-guiding body. A stopper is used to control the opening and closing of the air flow channel. The flow-guiding piston is disposed within the flow-guiding chamber. The flow-guiding chamber is divided by the valve body into a front and a rear air pressure chambers with different pressure area.

8 Claims, 10 Drawing Sheets

PAINTGUN WITH PNEUMATIC FEEDING AND DISCHARGING PROCESS

BACKGROUND OF THE INVENTION

1. Field of the Invention

The present invention relates to a paintgun with pneumatic feeding and discharging process, and more particularly, to a paintgun which controls the opening and closing of the airflow channel in such a way that the flow-field pressure is changed to complete two-stage feeding and discharging process.

2. Description of the Prior Art

A plurality of conventional paintguns (e.g. TW 447697, 443486, 406894, 437941, etc.), as shown in FIGS. 1 and 2, have a trigger assembly 11 above which a barrel assembly 12 is disposed. The barrel assembly 12 consists of an ejector tube 121 and an air chamber tube 122 both of which are in parallel with each other. A bore 13 is installed at the front end of the ejector tube 121 while a feeding tube 14 is fixed at the top thereof. The feeding tube 14 is connected with a loader to supply paintballs B. The air chamber tube 122 is fitted with an air valve 161 and an air valve spring 162 at the front end and with a delivery mechanism 17 at the rear end thereof. A hollow connector 18 is arranged at the bottom near the front end so as to be in connection with a tank 15. A pull rod 19 is disposed within the barrel assembly 12 and the rear end thereof projects from the barrel assembly 12.

Moreover, the pull rod 19 has a firing pin 191 within the air chamber tube 122, and the firing hammer 191 is coupled with the pull rod 19 by means of an insertion bolt 193. The front end of the firing hammer 191 is closed and pressed against the air valve 161 while the rear end thereof accommodates a spring 171 of a delivery mechanism 17 for pushing against the firing hammer 191. The firing hammer 191 is provided with positioning groove 192 at the bottom thereof (see FIG. 3). The movement of the firing hammer 191 can be controlled by an engaging member 111 of the trigger assembly 11 together with the positioning groove 192, thereby reaching the firing effect. However, the contact surface of the engaging member 111 and the positioning groove 192 will be rubbed after discharge of the paintgun each time. Accordingly, the engaging effect of the engaging member 111 will be lowered gradually such that it's easy to cause a firing by mistake. The safety is much threatened. Moreover, the components of the conventional paintgun are numerous, and the connection thereof is complicated so that it's not easy for assembly and malfunction.

In addition, as shown in FIG. 1, the pull rod 19 has to be pulled backward in position in prior to discharge. During the discharge, it moves to and fro such that the rear member 194 projecting from the barrel easily injure the human body. It's much dangerous.

Furthermore, the bolt 193 is easily broken off due to the side shear force when different axial action forces are exerted on the firing hammer 191 and the pull rod 19 during to-and-fro movement.

As shown in FIG. 2, when the trigger assembly 11 is pulled to bring the firing hammer 191 together with the pull rod 19 forwards, the air valve 161 is pushed open by the firing hammer 191, thereby releasing air pressure part of which flows into the air chamber tube 122 to return the firing hammer 191 in place and another part of which flows through a channel 123 and enters into the ejector tube 121 to discharge the paintball B. Accordingly, the air pressure used to discharge the paintball B has a curved and dispersed flow direction, thereby resulting in air turbulence. Therefore, the reduced air pressure can't bring the paintball B forward for discharge. Thus, the tank 15 has to be kept in a higher pressure. For example, most paintguns require a pressure at 50 kg/cm$^2$ for a smooth discharge of the paintball B to a prearranged distance. However, the higher the air pressure of the tank is, the more the cost thereof will be raised. Besides, the available air amount is also diminished and the danger is much elevated.

Consequently, the conventional paintgun leaves much to be improved.

SUMMARY OF THE INVENTION

It is a primary object of the present invention to provide a paintgun with pneumatic feeding and discharging process in which the paintball discharge is pneumatically controlled to replace the conventional mechanical way by engaging the firing hammer. Thus, the use safety is much ensured and the malfunction thereof is considerably reduced.

It is another object of the present invention to provide a paintgun with pneumatic feeding and discharging process which has advantages of simple configuration, easy assembly and low cost.

It is a further object of the present invention to provide a paintgun with pneumatic feeding and discharging process in which a limited amount of airflow is used to push a push tube forward first such that the paintball is brought forward to change the pressure of the front and rear ends of the flow-guiding valve. Accordingly, a great amount of airflow is brought through a major air channel for discharging the paintball. Thus, the present invention has advantages of smooth feeding of air flow. In addition, the paintball can be discharged by thrust of air flow even with smaller air pressure.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
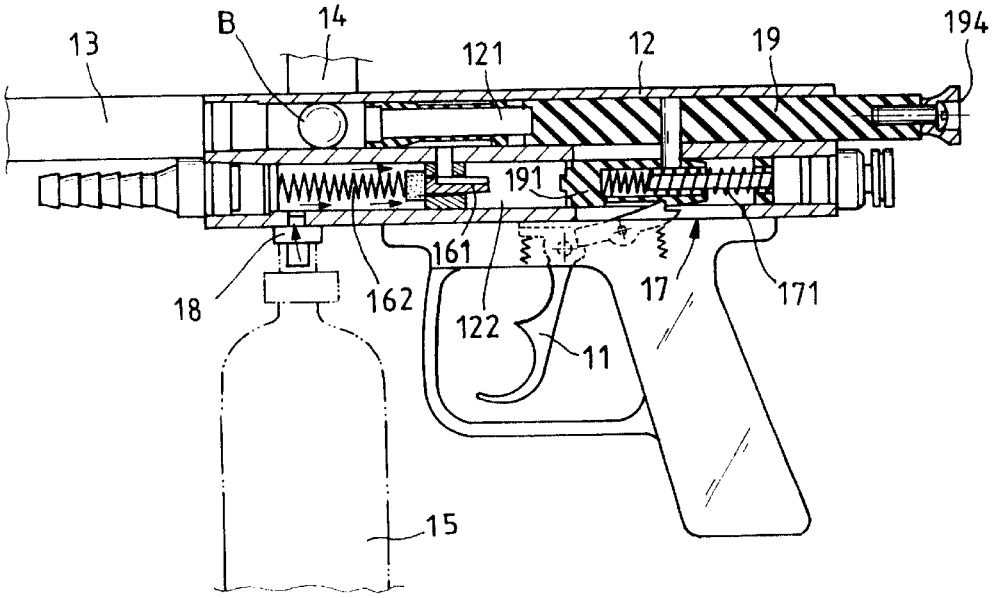
FIG. 1 PRIOR ART
FIG. 1 is a sectional view of a conventional paintgun before pulling the trigger.
Figure 2:
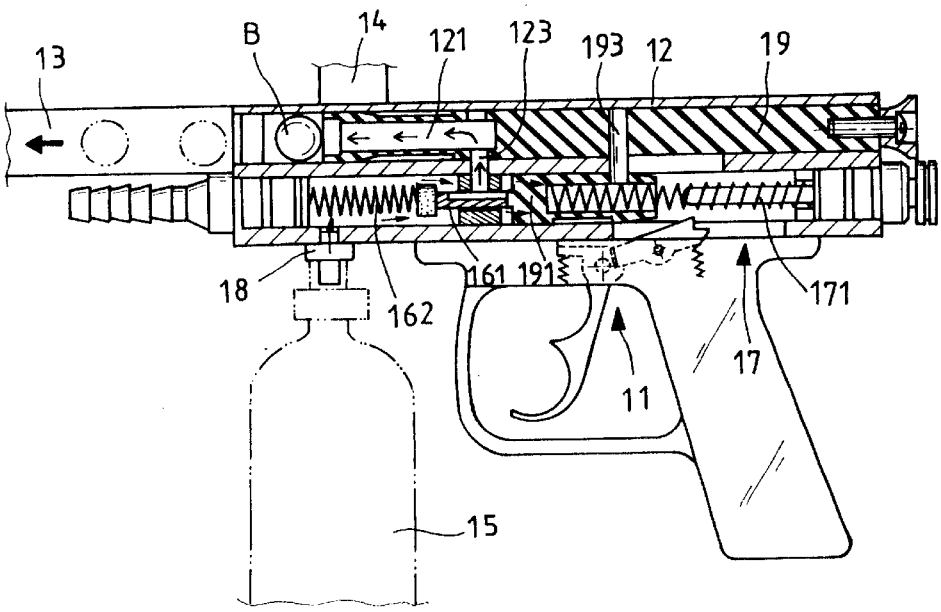
FIG. 2 PRIOR ART
FIG. 2 is a sectional view of the conventional paintgun after pulling the trigger.
Figure 3:
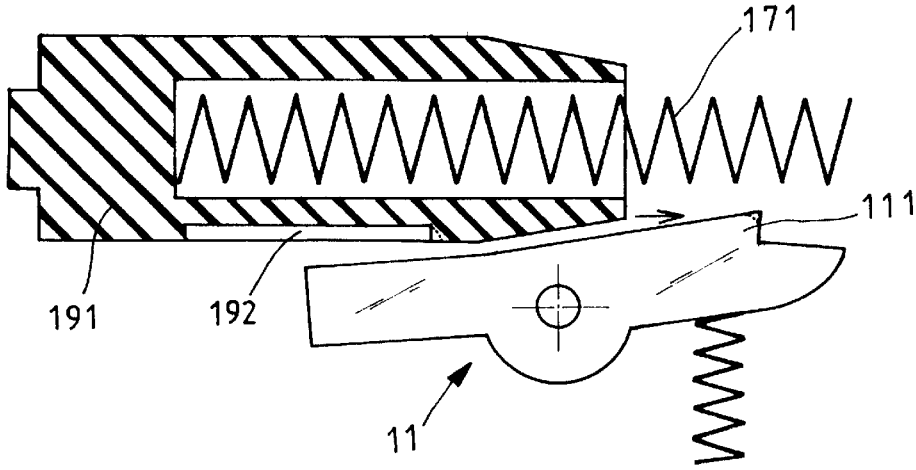
FIG.3 PRIOR ART
FIG. 3 is a schematic drawing of the trigger and the firing hammer of the conventional paintgun after pulling the trigger.
Figure 4:
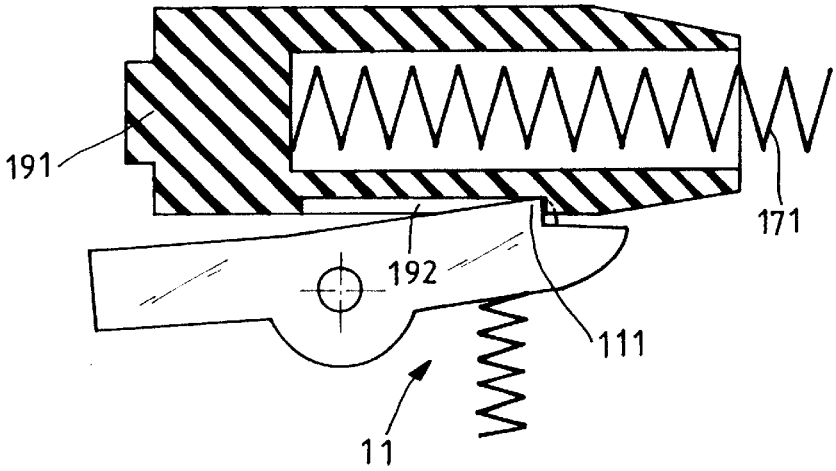
FIG.4 PRIOR ART
FIG. 4 is a schematic drawing of the trigger and the firing hammer of the conventional paintgun before pulling the trigger.
Figure 5:
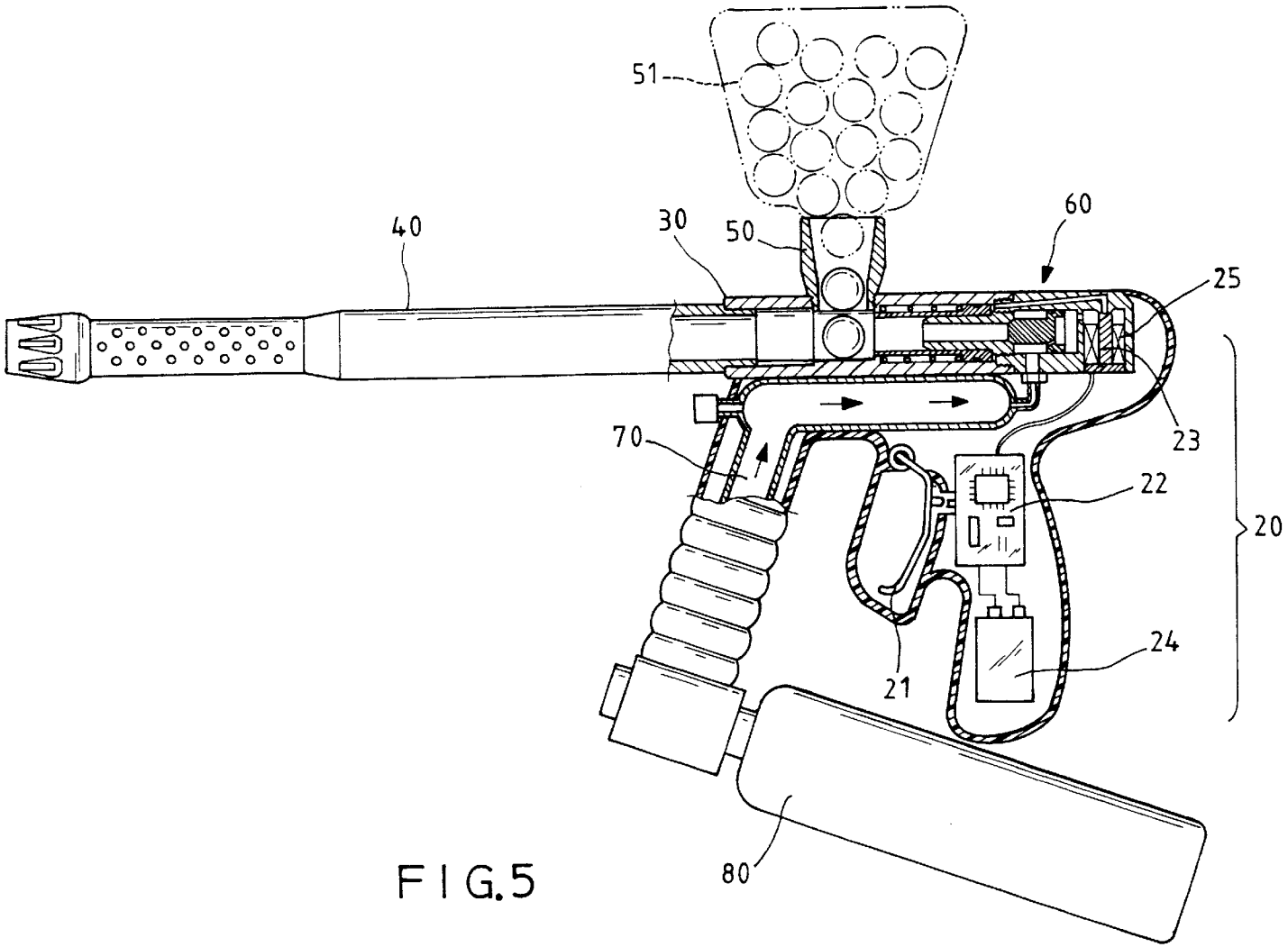
FIG. 5 is a sectional view of an applicable embodiment of the paintgun of the present invention.

First of all, referring to FIG. 5, an improvement of the paintgun of the present invention is shown. The paintgun in accordance with the present invention mainly includes a trigger assembly 20, a barrel assembly 30 and a pneumatic delivery mechanism 60. The trigger assembly 20 is used to actuate the firing element of paintballs B. The barrel assembly 30 is fitted above the trigger assembly 20. A bore 40 is provided at the front end thereof. Besides, a paintball-feeding tube 50 is disposed above the bore 40 for connecting with a tank 51 to supply paintballs B. The pneumatic delivery mechanism 60 is installed within the barrel assembly 30 and used to push and discharge the paintball. Since the trigger assembly 20, the barrel assembly 30, the bore 40, the paintball-feeding tube 50 and the tank 51 are necessary components of a paintgun and aren't object of the present invention, no further descriptions are given hereinafter.

Figure 6:
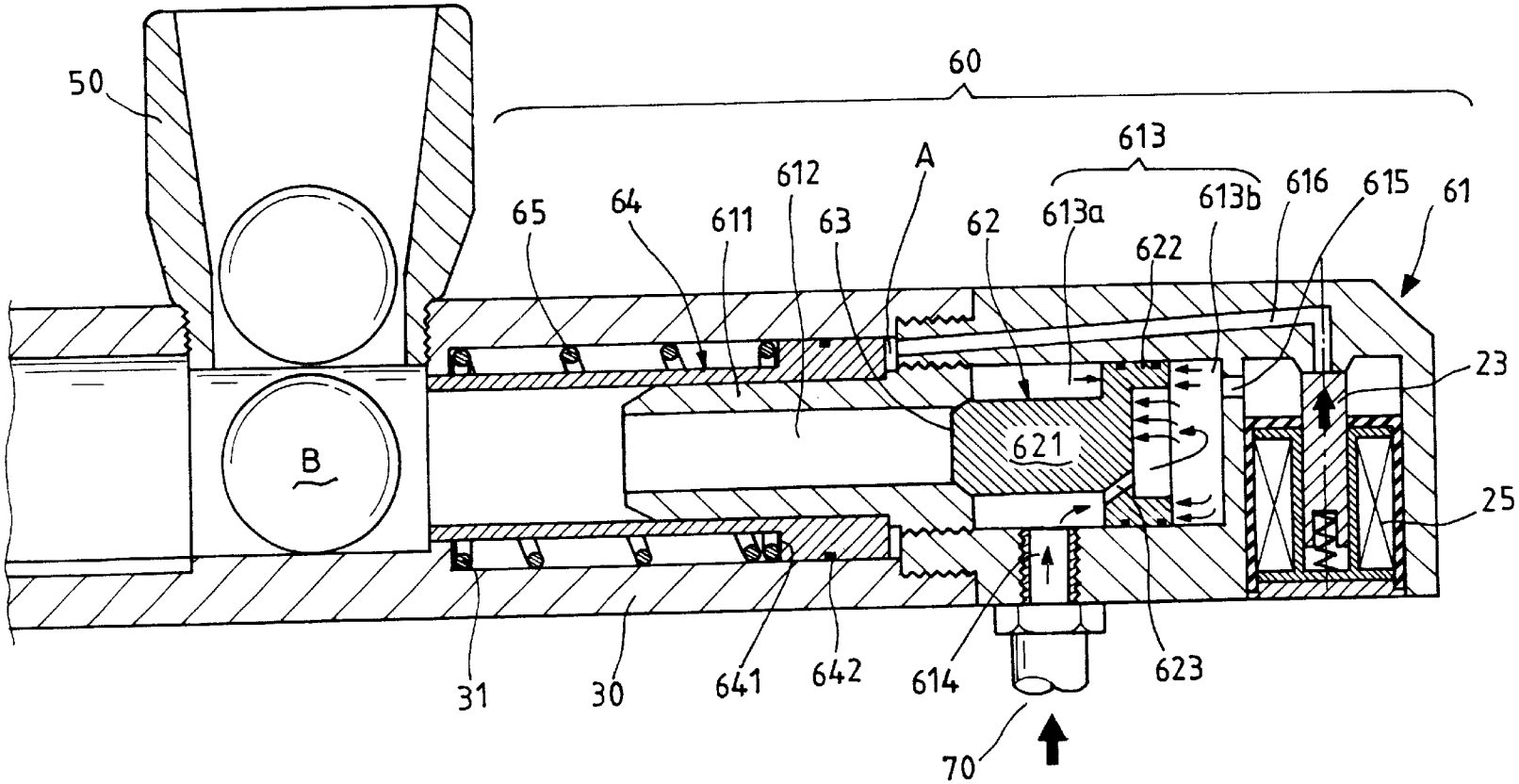
FIG. 6 is a sectional view of a pneumatic delivery mechanism in initial state.

The main configuration of the present invention lies in the principle and technique of the pneumatic delivery mechanism 60. Referring to FIG. 6, the pneumatic delivery mechanism 60 includes a flow-guiding body 61, a flow-guiding piston 62 and a delivery tube 64. The flow-guiding body 61 is fixed at the rear end of the barrel assembly 30. The front end of the flow-guiding body 61 is constructed as tube 611 with smaller diameter and projects into the barrel assembly 30. The tube 611 is screwed, welded or riveted to the front end of the flow-guiding body 61. Beside, the flow-guiding body 61 has an axially extended hole which consists of a major air channel 612 at the front end and a flow-guiding chamber 613 at the rear end thereof. The flow-guiding chamber 613 includes an input port 614 at one side thereof which is in connection with an air pressure source 70 and an output port 615 at the other side thereof which communicates with a minor air channel 616 at the wider part of the flow-guiding body 61. A stopper 23 is used to control the opening and closing of the air flow channel. The minor air channel 616 is connected into the barrel assembly 30. The movement of the stopper 23 is controlled by the trigger assembly 20.

The flow-guiding piston 62 is disposed within the flow-guiding chamber 613 with a slimmer front part and a wider rear part. An air piston 621 at the front end of the flow-guiding piston 62 is forced against the major air channel 612 while a valve body 622 at the rear end of the flow-guiding piston 62 is inserted into the internal wall of the flow-guiding chamber 613 such that the flow-guiding chamber 613 is divided by the valve body 622 into a front and a rear air pressure chambers 613*a*, 613*b* with different pressure area. A small through hole 623 is interposed between the front and rear air pressure chambers 613*a*, 613*b*.

The delivery tube 64 is placed around the tube 611 at the front end of the flow-guiding body 61. A return spring 65 is disposed around the front part of the delivery tube 64.

Accordingly, the stopper 23 is used to control the opening or closing of air flow channel, thereby leading to a pressure difference between the front and rear air pressure chambers 613*a*, 613*b* of the flow-guiding piston 62. As a result, the delivery tube 64 is shifted forward by means that a small amount of air flow is fed into the minor air channel 616 so as to push a paintball B a little forward. Thereafter, the paintball B is discharged by means of thrust of air flow into the major air channel 612.

The delivery tube 64 has a flange 641 at the rear end thereof against which one end of the return spring 65 is fixed. Moreover, the barrel assembly 30 is provided with a corresponding flange 31 against which the other end of the return spring 65 is pressed. An O-ring 642 is disposed around the outer circumference of the rear end of the delivery tube 64.

The above-mentioned are the primary structure and features of the pneumatic delivery mechanism 60. The operational principles thereof, as shown in FIGS. 6 through 8, are described as follows:

First of all, referring to FIG. 6, the initial state of the pneumatic delivery mechanism 60 is shown. Here, the stopper 23 closes the passage of the minor air channel 616 while the air pressure source 70 of high pressure gas enters through the input port 614 into the flow-guiding chamber 613. Then, it passes through the small through hole 623 into the rear air pressure chamber 613*b*. The pressure area of the rear air pressure chamber 613*b* upon the valve body 622 is much greater than the closing area 63 of the air valve 621. Therefore, the flow-guiding piston 62 is shifted forward. Meanwhile, the air valve 621 is pressed against the passage of the major air channel 612, thereby blocking the air pressure released from the major air channel 612.

Figure 7:
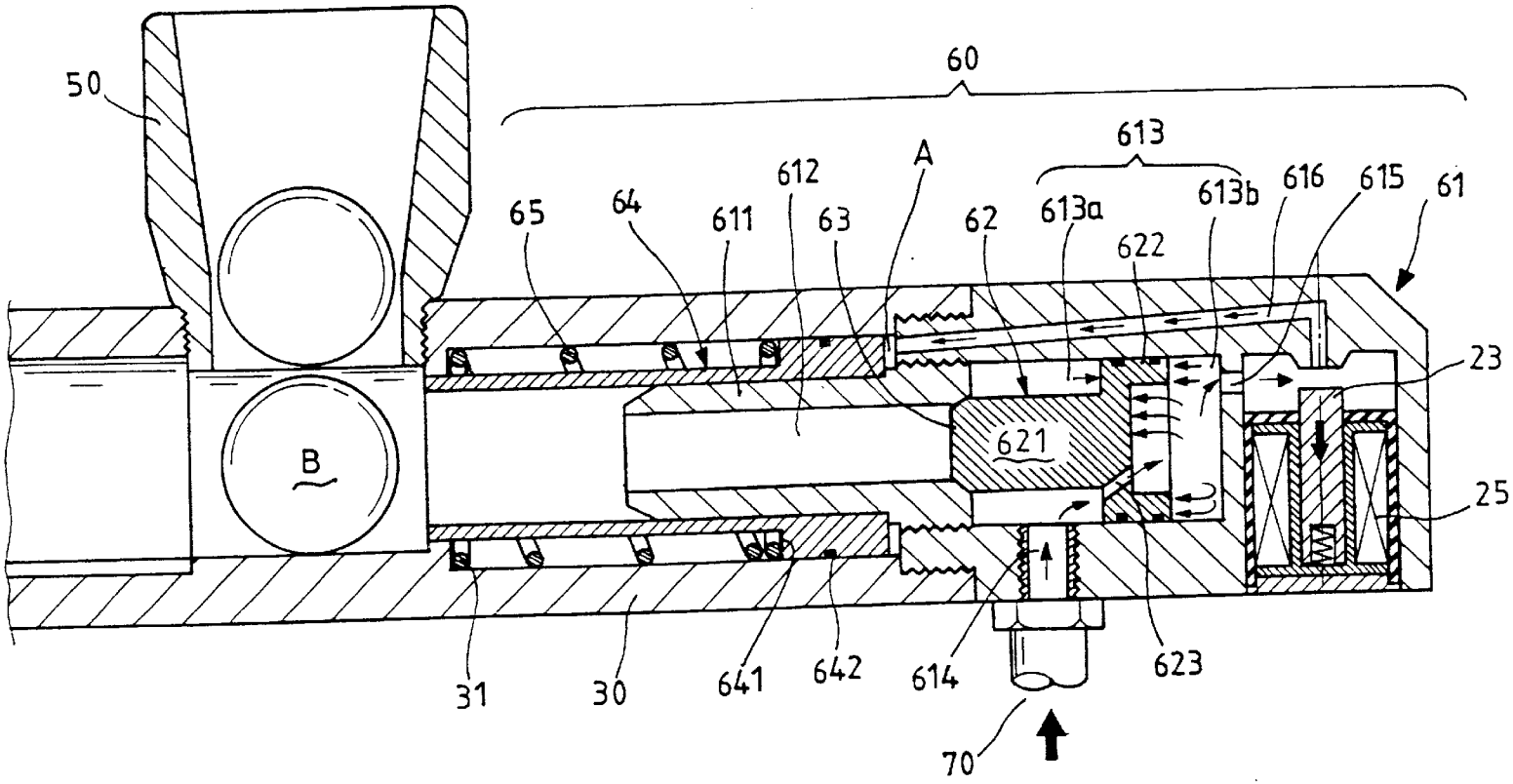
FIG. 7 is a sectional view of the pneumatic delivery mechanism in an opened state by a stopper.
Figure 8:
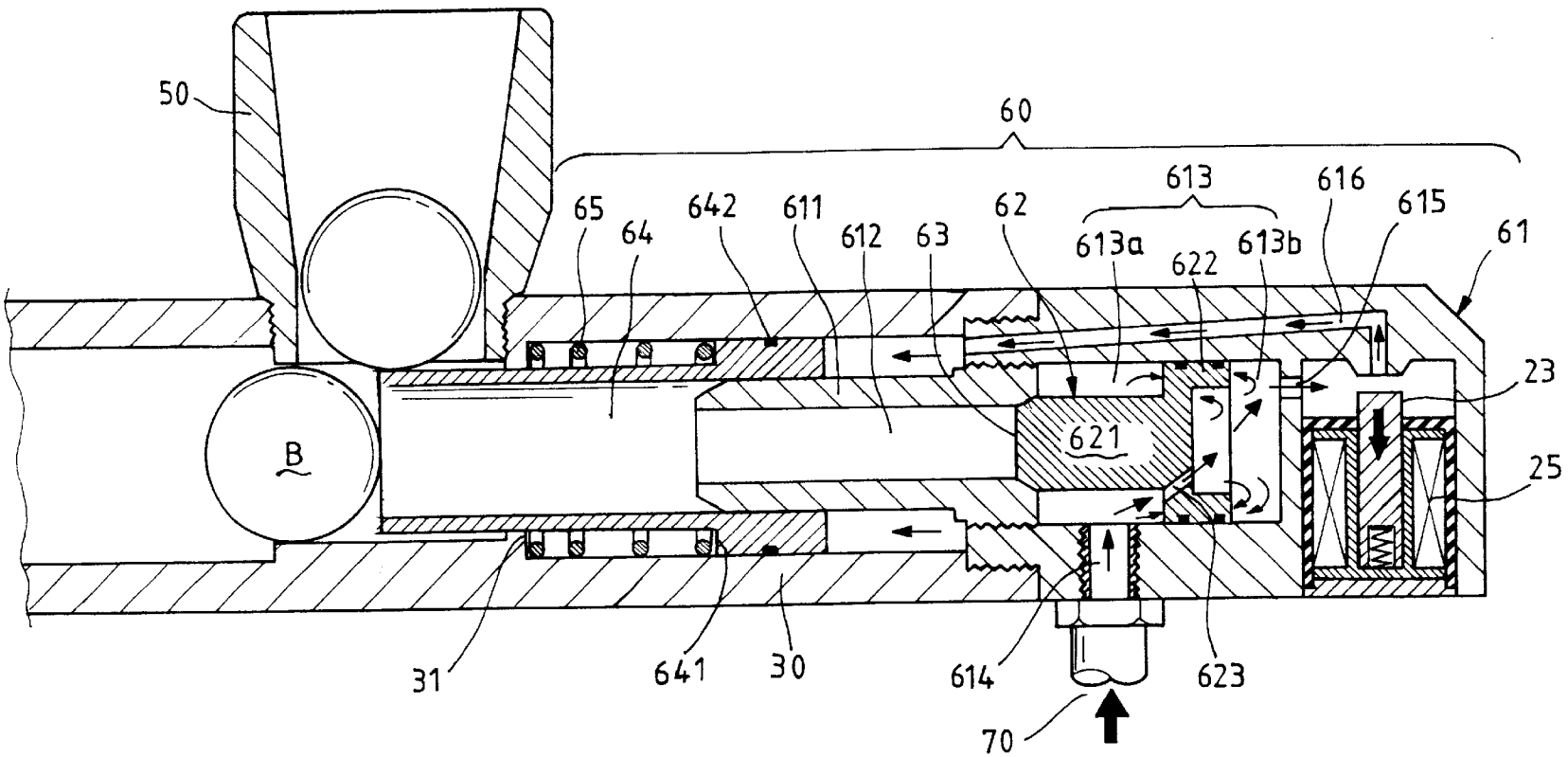
FIG. 8 is a sectional view of the pneumatic mechanism showing that the paintball is shifted forward by limited airflow through minor air channel.
Figure 9:
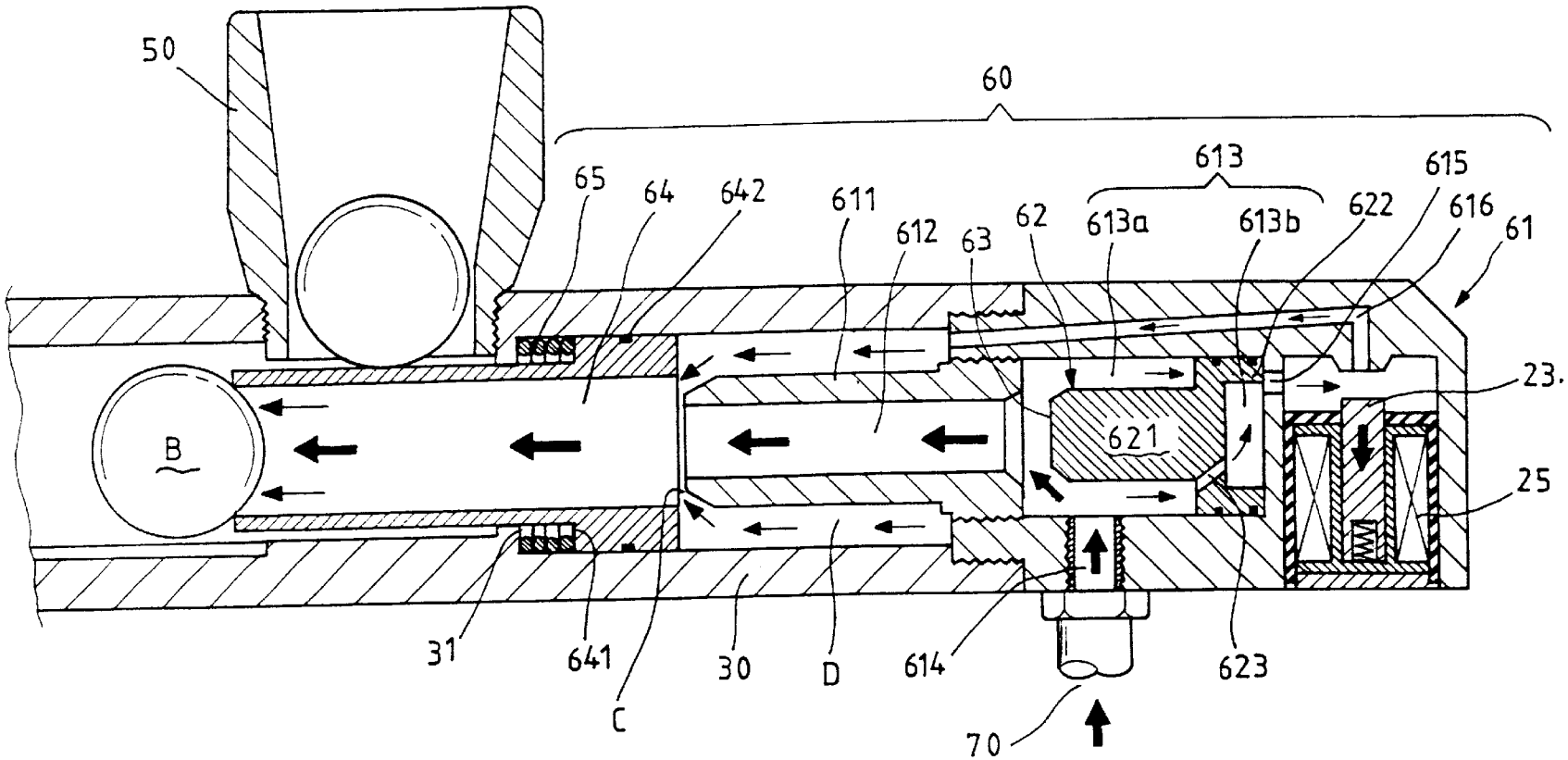
FIG. 9 is a sectional view of the pneumatic mechanism showing that the paintball is discharged by a great amount of airflow through major air channel.

Then, referring to FIG. 7, the stopper 23 is controlled by the trigger assembly 20 to be moved downward such that the passage of the minor air channel 616 is opened. Here, the high pressure gas within the rear air pressure chambers 613*b* may enter through the output port 615 and the minor air channel 616 into the rear side (the area marked with A) of the delivery tube 64 of the barrel assembly 30. As a result, this air pressure can push the delivery tube 64 forward, thereby bringing the paintball B falling from the paintball-feeding tube 50 forward. The volumen A of the pushing surface of the delivery tube 64 is smaller than the rear air pressure chambers 613*b*. Meanwhile, the air flow is continuously fed through the small through hole 623 into the rear air pressure chambers 613*b*. Since the pushing force on the valve body 622 is still greater than the force on the closing area 63 of the air valve 621, the flow-guiding piston 62 won't be moved. Furthermore, referring to FIG. 8, when the delivery tube 64 is shifted forward to gradually depart from the tube 611 at the front end of the flow-guiding body 61, the area of the inner tube of the barrel assembly 30 is increased and the air flow, as shown in FIG. 9, is led into the delivery tube 64. Since the small through hole 623 only receives limited amount of air flow to feed into the rear air pressure chambers 613*b*, the gas pressure of flow field is changed. Here, the pressure within the rear air pressure chambers 613*b* is lowered. Meanwhile, the pressure within the front air pressure chambers 613*a* is increased in the way that it is greater than that of the rear air pressure chambers 613*b* so that the flow-guiding piston 62, as shown in FIG. 9, is shifted backward such that the air valve 621 departs from the input port of the major air channel 612. Therefore, a great amount of gas thrusts past major air channel 612 into the delivery tube 64, thereby discharging the paintball B.

Figure 10:
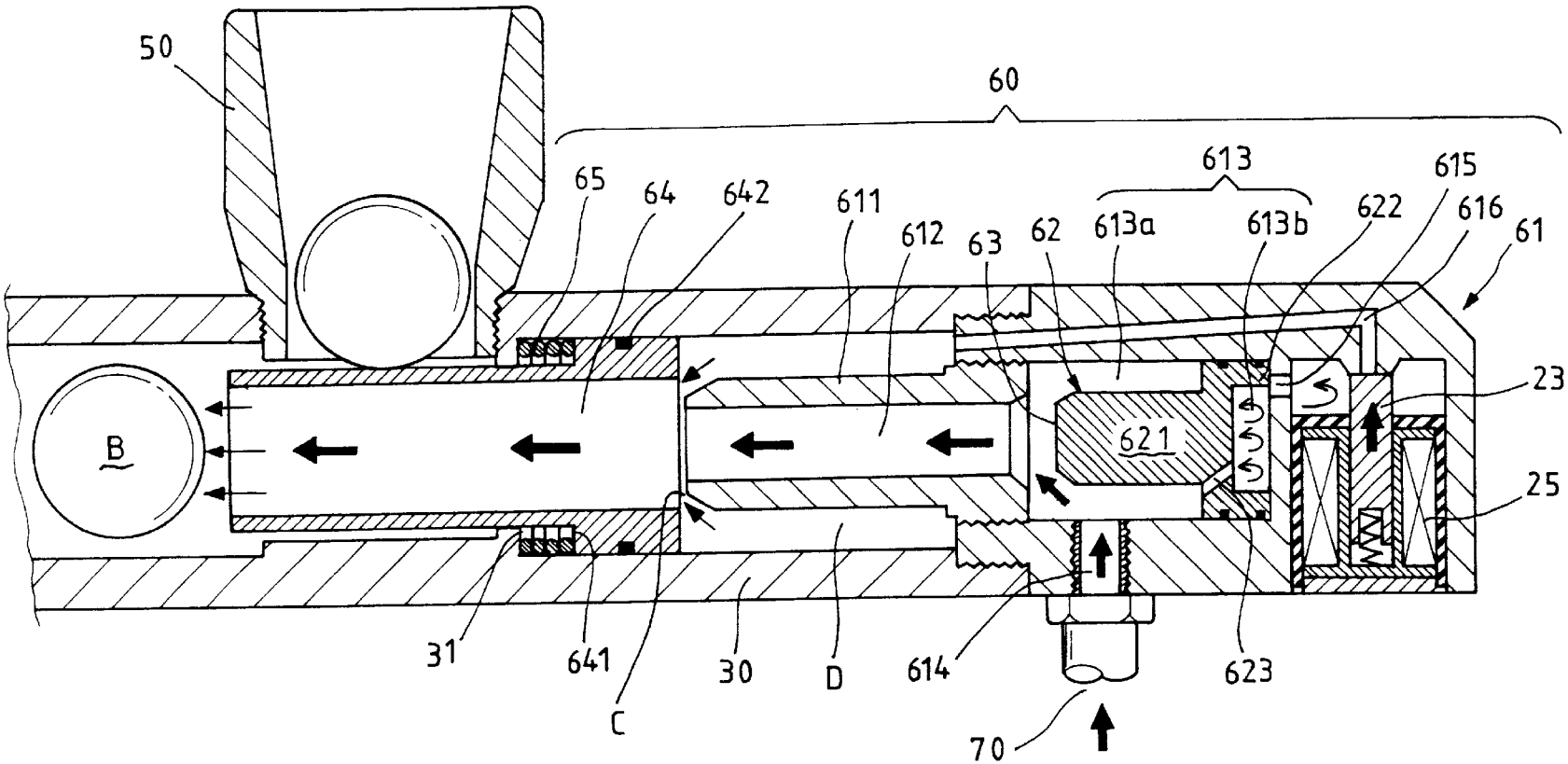
FIG. 10 is a sectional view of the pneumatic mechanism in a closed state by a stopper.
Figure 11:
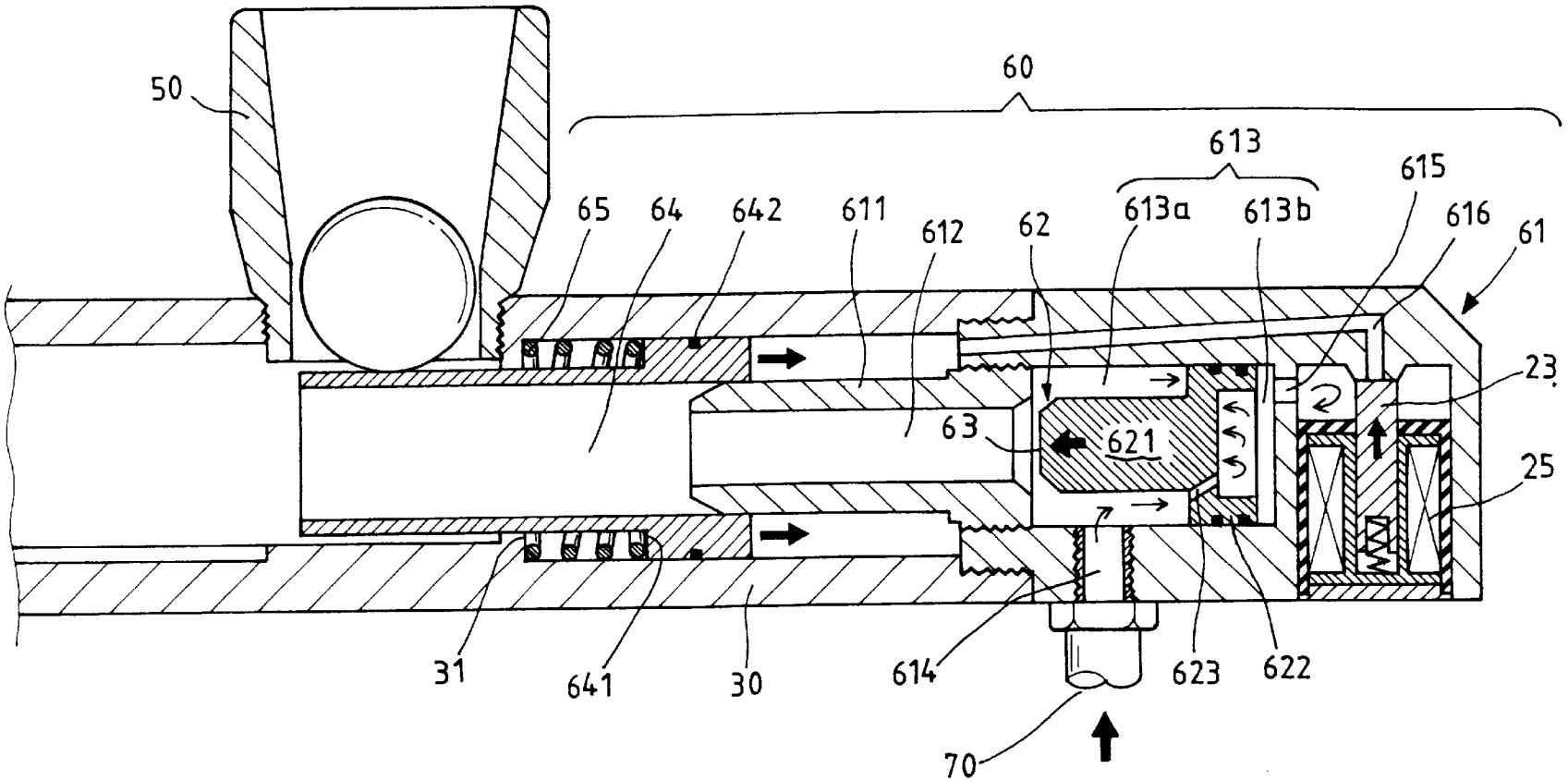
FIG. 11 is a sectional view of the pneumatic mechanism showing the movement of the flow-guiding valve.

Thereafter, referring to FIG. 10, the stopper 23 shifts upward to renewedly close the passage of air flow. Here, the flow-field pressure is changed and the front and the rear air pressure chambers 613*b* regains the pressure. In addition, when air flow thrusts into the major air channel 612, the top end C opposite to the delivery tube 64 creates a draw-off effect of the fluid mechanics. Therefore, the gas in the area D of the barrel assembly 30 is drawn off and shown in half-vacuum state to reduce the resistance of the return spring 65 back to the delivery tube 64. Thus, referring to FIG. 11, the delivery tube 64 returns and the pressure area of the rear air pressure chamber 613*b* upon the valve body 622 is much greater than the closing area 63 of the air valve 621 in the front air pressure chambers 613*a*. Accordingly, the initial state in FIG. 6 is regained.

Figure 12:
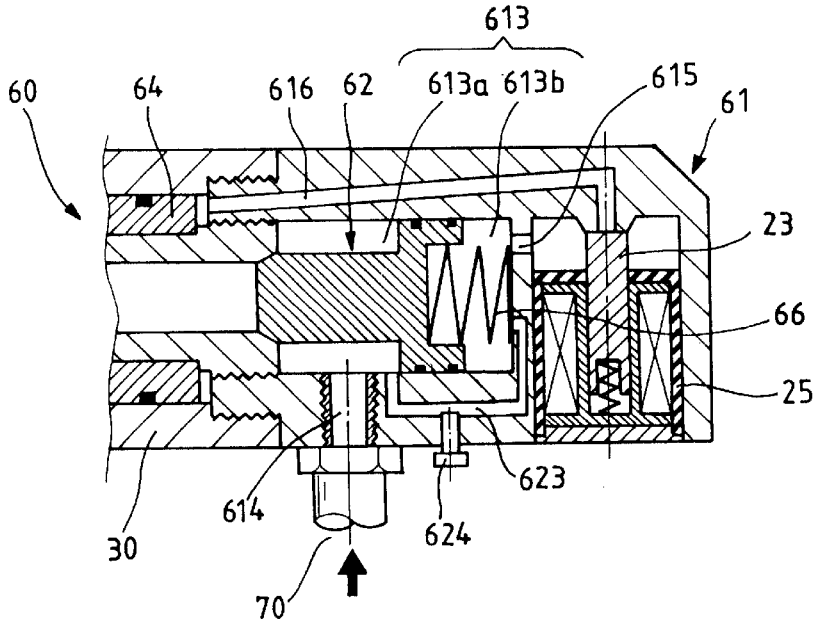
FIG. 12 is a sectional view of another applicable embodiment of the pneumatic delivery mechanism.

Of course, the position of the above-mentioned components of the pneumatic delivery mechanism 60 can be changed as needed. Referring to FIG. 12, another applicable embodiment of the pneumatic delivery mechanism 60 is shown. The small through hole 623 is disposed in the flow-guiding body 61 at one side of the front and rear air pressure chambers 613*a*, 613*b* while a screw 624 is used to control the flow rate of the small through hole 623. Furthermore, the flow-guiding piston 62 includes a small spring 66 in the rear air pressure chambers 613*b* to help the flow-guiding piston 62 to spring back to the original position.

Figure 13:
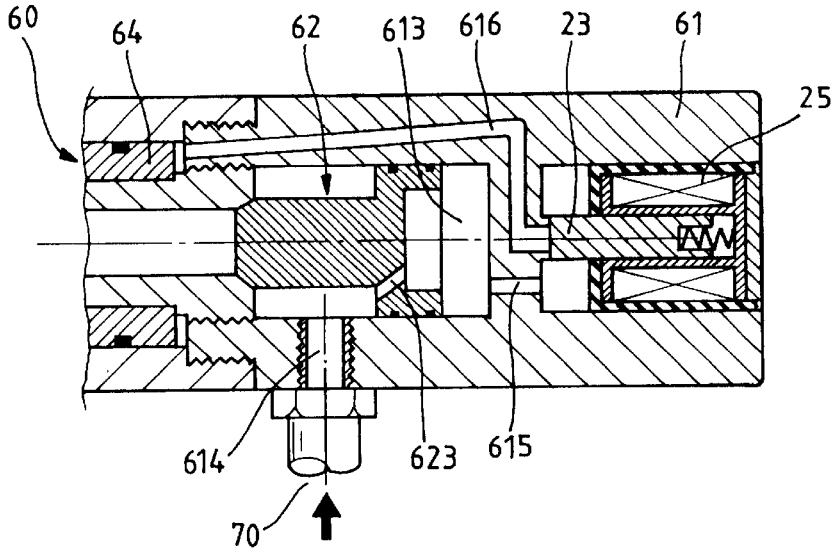
FIG. 13 is a sectional view of a further applicable embodiment of the pneumatic delivery mechanism.

As shown in FIG. 13, the stopper 23 can be installed according to the direction of the output port 615 and the input port of the minor air channel 616. The functions thereof are all unchanged.

Again, referring to FIG. 5 together with the other figures, the stopper 23 of the present invention can be configured as a central shaft or the like of a control element 25 of an electromagnetic valve or an electromagnet. In this embodiment, the electromagnetic valve is used as control element 25. Besides, the trigger assembly 20 includes a trigger 21, firing circuit 22 and batteries 24. In pulling the trigger 21, the switch of the firing circuit 22 is actuated, thereby shifting the stopper 23 of the control element 25 to achieve the control effect of the passage. However, the trigger assembly 20 and the electromagnetic valve are conventional elements so that no further descriptions are given hereinafter.

In addition, the air pressure source 70 is supplied by a tank 80 or others.

According to the above-mentioned, the pneumatic delivery mechanism 60 of the present invention makes use of the change of the flow-field pressure. A minor air flow is used to push the delivery tube 64 first so as to bring the paintball B forward. Then, the discharge is performed by the thrusting air flow. The two-stage air delivery system achieves the following effects:

1. Unlike the conventional paintgun, the present invention doesn't have the firing hammer to open the air valve so that the wearing of the mechanic engagement can be avoided. Moreover, the danger of the reciprocating shift of the push rod can be eliminated. As a result, the safety in whole can be enhanced.
2. The present invention has simple configuration and easy assembly so that the malfunction rate is reduced.
3. The most important lies in that the minor air channel 616 is closed when the major air channel 612 uses airflow. Thus, the great amount of airflow can be concentrated without dispersion so that the paintball can be smoothly and axially discharged in acceleration way. As shown in FIG. 8, when the paintball is discharged through the major air channel 612, the feeding opening at the bottom of the paintball-feeding tube 50 is closed by the delivery tube 64 so that the air flow won't be dispersed to create air turbulence. Consequently, the present invention can smoothly discharge the paintball B to preset distance only under the pressure of 20 kg/cm$^2$. Therefore, the pressure of the air pressure source 70 can be reduced and the same pressure source can be used for a longer time. Accordingly, the safety can not only be elevated, but also the cost can be reduced.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A paintgun with pneumatic feeding and discharging process comprising:

a trigger assembly used to actuate the firing element of paintballs;

a barrel assembly fitted above said trigger assembly, a bore being provided at the front end thereof, a paintball-feeding tube being disposed above said bore;

a pneumatic delivery mechanism installed within said barrel assembly;

wherein the improvement of the present invention is characterized by said pneumatic delivery mechanism comprising:

a flow-guiding body fixed at the rear end of said barrel assembly, the front end of said flow-guiding body being constructed as tube with smaller diameter and projecting into said barrel assembly, said flow-guiding body having an axially extended conic hole which consists of a major air channel at the front end and a flow-guiding chamber at the rear end thereof, said flow-guiding chamber having an input port at one side thereof which is in connection with an air pressure source and an output port at the other side thereof which communicates with a minor air channel at the wider part of said flow-guiding body, a stopper being used to control the opening and closing of the air flow channel, said minor air channel being connected into said barrel assembly, the movement of said stopper being controlled by said trigger assembly;

a flow-guiding piston disposed within said flow-guiding chamber with a slimmer front part and a wider rear part, an air piston at the front end of said flow-guiding piston being forced against said major air channel while a valve body at the rear end of said flow-guiding piston is inserted into the internal wall of said flow-guiding chamber such that the flow-guiding chamber is divided by said valve body into a front and a rear air pressure chambers with different pressure area, a small through hole being interposed between said front and rear air pressure chambers; and a delivery tube being placed around said tube at the front end of said flow-guiding body, a return spring being disposed around the front part of said delivery tube;

so that said stopper is used to control the opening or closing of air flow channel, thereby leading to a pressure difference between said front and rear air pressure chambers of said flow-guiding piston, and said delivery tube is shifted forward by means that a small amount of air flow is fed into said minor air channel so as to push a paintball a little forward; thereafter, said paintball is discharged by means of thrust of air flow into said major air channel.

2. The paintgun with pneumatic feeding and discharging process as claimed in claim 1 wherein said delivery tube has a flange at the rear end thereof against which one end of said return spring is fixed, and wherein said barrel assembly is provided with a corresponding flange against which the other end of said return spring is pressed, and wherein an O-ring is disposed around the outer circumference of the rear end of the delivery tube.

3. The paintgun with pneumatic feeding and discharging process as claimed in claim 1 wherein said small through hole between aid front and rear air pressure chambers is arranged in said flow-guiding piston.

4. The paintgun with pneumatic feeding and discharging process as claimed in claim 1 wherein said small through hole between aid front and rear air pressure chambers is arranged in the wider part of said flow-guiding body.

5. The paintgun with pneumatic feeding and discharging process as claimed in claim 3 wherein said flow-guiding piston includes a small spring at the rear side thereof.

6. The paintgun with pneumatic feeding and discharging process as claimed in claim 1 wherein said trigger assembly includes a trigger, firing circuit, batteries and control elements.

7. The paintgun with pneumatic feeding and discharging process as claimed in claim 6 wherein said control element includes a stopper.

8. The paintgun with pneumatic feeding and discharging process as claimed in claim 1 wherein said air pressure source is supplied by an air pressure tank.

* * * * *